US009930920B2

(12) United States Patent
Le

(10) Patent No.: US 9,930,920 B2
(45) **Date of Patent: *Apr. 3, 2018**

(54) METHOD FOR SECURING EXTENSION LASHES DURING AN EYELASH EXTENSION PROCEDURE

(71) Applicant: Jessica Le, Houston, TX (US)

(72) Inventor: Jessica Le, Houston, TX (US)

( * ) Notice: Subject to any disclaimer, the term of this patent is extended or adjusted under 35 U.S.C. 154(b) by 60 days.

This patent is subject to a terminal disclaimer.

(21) Appl. No.: 14/936,676

(22) Filed: Nov. 9, 2015

(65) Prior Publication Data

US 2016/0058088 A1 Mar. 3, 2016

Related U.S. Application Data

(63) Continuation-in-part of application No. 13/586,888, filed on Sep. 10, 2012, now Pat. No. 9,179,722.

(51) Int. Cl.
*A41G 5/02* (2006.01)

(52) U.S. Cl.
CPC ..... *A41G 5/02* (2013.01)

(58) Field of Classification Search
CPC ..... A41G 5/02; A41G 5/0086; A41G 5/006; A41G 5/0053
USPC ..... 132/201, 216, 218, 53–56
See application file for complete search history.

(56) References Cited

U.S. PATENT DOCUMENTS

| | | | | |
|---|---|---|---|---|
| 3,315,689 | A * | 4/1967 | Melik | A41G 5/02 132/317 |
| 3,362,417 | A * | 1/1968 | Glaser | A41G 5/02 132/201 |
| 3,900,038 | A * | 8/1975 | Masters | A41G 5/02 132/201 |
| 7,222,629 | B1 * | 5/2007 | Han | A41G 5/02 132/216 |
| D669,223 | S * | 10/2012 | Lee | D28/73 |
| 8,424,542 | B1 * | 4/2013 | Han | A45C 11/00 132/212 |
| 8,881,744 | B2 * | 11/2014 | McKinstry | A45D 44/00 132/216 |
| 2002/0056465 | A1 * | 5/2002 | Shin | A41G 5/02 132/53 |
| 2005/0061341 | A1 * | 3/2005 | Choe | A41G 5/02 132/53 |
| 2007/0023062 | A1 * | 2/2007 | McKinstry | A41G 5/02 132/201 |

(Continued)

*Primary Examiner* — Todd E Manahan
*Assistant Examiner* — Jennifer Gill
(74) *Attorney, Agent, or Firm* — Spradley PLLC; Michael Spradley

(57) ABSTRACT

A method of extending eyelashes is described herein. Specifically, an adhesive-based method of extending eyelashes is disclosed. The method can comprise wearing a ring on a first hand and manipulating forceps with a second hand. The ring can comprise a bowl, while the bowl can comprise eyelash adhesive. In addition, the method can comprise attaching a first side of an eye patch to a surface, attaching a tape on a second side of the eye patch, and supporting a plurality of loose extension lashes on the tape. The extension lashes on the tape can be removed with forceps. A portion of the eyelash extension can be dipped into the eyelash adhesive within the ring. Lastly, the method can comprise attaching the eyelash extension to a natural lash on a user.

9 Claims, 10 Drawing Sheets

(56) References Cited

U.S. PATENT DOCUMENTS

| | | | | |
|---|---|---|---|---|
| 2007/0227550 | A1* | 10/2007 | Merszei | A41G 5/02 132/53 |
| 2007/0272264 | A1* | 11/2007 | Byrne | A41G 5/02 132/201 |
| 2009/0126134 | A1* | 5/2009 | Whipple | A61C 3/00 15/104.94 |
| 2009/0178689 | A1* | 7/2009 | Navarro | A41G 5/02 132/201 |
| 2009/0235950 | A1* | 9/2009 | Dinh | A41G 5/02 132/216 |
| 2009/0241979 | A1* | 10/2009 | Navarro | A41G 5/02 132/201 |
| 2010/0000563 | A1* | 1/2010 | Dinh | A41G 5/02 132/201 |
| 2010/0170526 | A1* | 7/2010 | Nguyen | A41G 5/02 132/201 |
| 2012/0060861 | A1* | 3/2012 | Van Cleef | A45D 33/33 132/316 |

* cited by examiner

METHOD FOR SECURING EXTENSION LASHES DURING AN EYELASH EXTENSION PROCEDURE

PRIORITY

This application is a continuation in part of application Ser. No. 13/586,888 entitled "Improved Method for Extending Eyelashes" by Jessica Le, filed on Aug. 6, 2012.

BACKGROUND

This disclosure relates to a system and method for securing extension lashes during an eyelash extension procedure.

Methods for enhancing eyelashes have evolved over the years. Having thick or dark eyelashes can give a person a more feminine and youthful appearance. Additionally, defined and dark eyelashes can make a person's eye appear larger and attractive. Eye mascara is used to darken, thicken, lengthen, curl or redefine eyelashes. Specifically, mascara can have liquid, cake, or cream forms that can have different formulas. However, mascara is a form of cosmetic that lasts only a few hours. Furthermore, each application of mascara can be time-consuming to achieve the desired look for the eyelashes. Additionally, chemicals in mascara can sometimes damage the lashes, causing them to become dry and brittle. Moreover, mascara is more likely create blots or make the lashes appear caked when too much product is applied.

A popular alternative known as false eyelashes has been developed to enhance the appearance of eyelashes. False eyelashes usually come in a small package, which contain strips of fake lashes, and a sticky adhesive. The sticky adhesive can be applied to synthetic lashes and the full strip of lashes can be attached to the upper eyelid with the aid of tweezers. However, this process can be messy, because excess adhesive can scatter around the eyelid. Moreover, eyes can feel heavy and tired with a full cluster of synthetic eyelashes applied on the eyelid. Additionally, bundled fake eyelashes can be applied to multiple natural lashes, multiple lashes end up bonded together. This can permanently damage the cluster of eyelashes.

Given the complexity of applying lashes, self-application of fake lashes can also be difficult. Due to the high time-consumption of applying the full strip of fake lashes into the natural lash line, lashes can be improperly applied because of quickly drying adhesive. Furthermore, even after proper placement, false eyelashes can still appear fake and stiff.

A more recent alternative to fake lashes administered in a strip is having a lash technician glue individual lashes to real lashes. In such method, the lash technician typically has a small bowl of loose lashes and a jar of glue. The technician separates a lash from the bowl of lashes and grabs it with tweezers, dips an end of the lash in glue, and applies it to the client. However, such process must be done for each individual lash and can be quite time consuming, taking an hour or more to apply a set of lash extensions.

It would therefore be advantageous to have an improved method for securing extension lashes during an eyelash extension procedure.

SUMMARY

A method for securing extension lashes during an eyelash extension procedure is described herein. Specifically, an adhesive-based method of extending eyelashes is disclosed. The method can comprise wearing a ring on a first hand and manipulating forceps with a second hand. The ring can comprise a bowl, while the bowl can comprise eyelash adhesive. In addition, the method can comprise attaching a first side of an eye patch to a surface, attaching a tape on a second side of the eye patch, and supporting a plurality of loose extension lashes on the tape. The extension lashes on the tape can be removed with forceps. A portion of the eyelash extension can be dipped into the eyelash adhesive within the ring. Lastly, the method can comprise attaching the eyelash extension to a natural lash on a user.

DETAILED DESCRIPTION

Described herein is a system and method for securing extension lashes during an eyelash extension procedure. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
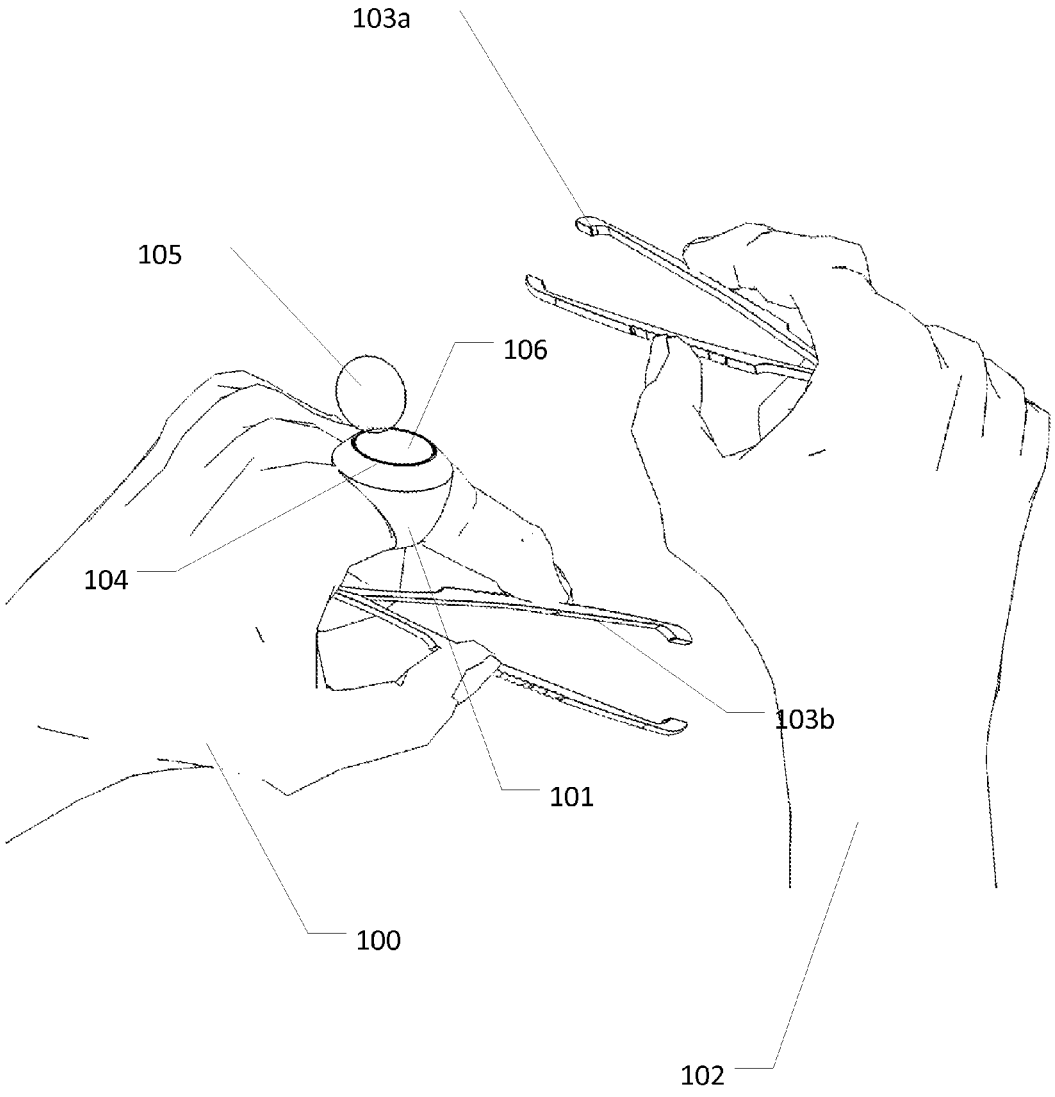
FIG. 1 illustrates a first hand wearing a ring, and a second hand holding a forceps.

FIG. 1 illustrates a first hand 100 wearing a ring 101, and a second hand 102 holding forceps 103. Ring 101 can be a circular band that can be worn around a finger. Ring 101 can be made of any materials such as plastic, metal and/or glass that can be designed in various color, shape, and/or sizes. Forceps 103 can be any tool, such as tweezers, which can be used for manipulating natural lashes and lash extensions.

Furthermore, ring 101 can comprise a container 104, and a lid 105. Container 104 can be used for storing glue 106. Glue 106 can be made of a sticky and/or liquid adhesive material for adhering a prosthetic lash to a natural lash. In one embodiment, container 104 can be a concave portion at the top surface of ring 101. In such embodiment, ring 101 and container 104 can be molded as a single device. In another embodiment, container 104 can be a small receptacle attached to ring 101 through weld, solder, glue or other method known in the art. Lid 105 can cover or seal container 104.

Figure 2:
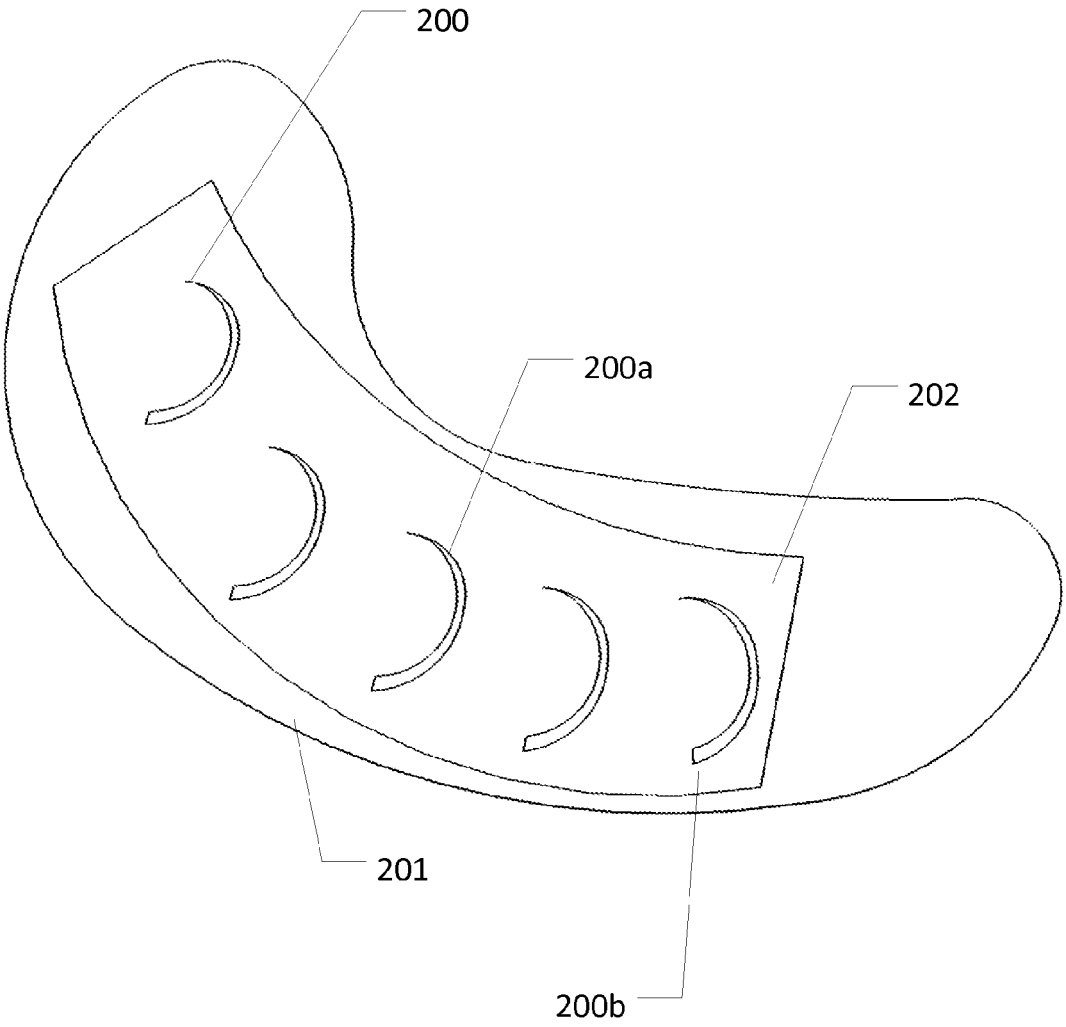
FIG. 2 illustrates a plurality of extension lashes attached to an eyepatch.

FIG. 2 illustrates a plurality of extension lashes 200 attached on a piece of an eye patch 201. Extension lashes 200 can be designed with various length, thickness, color, and/or curl. Extension lashes 200 can be divided into two parts, a base 200*a*, and a tip 200*b*. Base 200*a* can be the thicker part of extension lashes 200, while tip 200*c* can be thinner end of extension lashes 200. Base 200*a* can be the portion of extension lashes 200 that can be adhered onto a natural lash.

As a non-limiting example, extension lashes 200 can have a length that is between 1 to 30 millimeters. As another non-limiting example, extension lashes 200 can have a thickness that is between 0.01 to 0.25. As another non-limiting example, extension lashes 200 can have various curls, which can range between straight, curled, and extra-curled. Eye patch 201 can be worn around near the eye area. In a preferred embodiment, eyepatch 201 can be an under eye patch curved in a shape that is compatible to be placed under the eye area. Eye patch 201 can comprise tape 202. Tape 202 can be any strip of material capable holding eyelashes in an orderly manner and maintaining a fixed position during extension lash 200 removal from tape and installation onto user. In one embodiment, eye patch 201 can comprise adhesive on one or both sides. In such embodiment, a first side of eyepatch 201 that attaches on the eye area can comprise of gel and/or a mask that is capable of adhering to the skin, while a second side of eye patch 201 can comprise an adhesive that can hold extension lashes 200. In another embodiment, eyepatch 201 can support tape 202 on a top surface of eyepatch 201, while a bottom surface of eyepatch 201 can affix to the user's skin. Tape 202 can be double-sided. One side of tape 202 can connect to eyepatch 201, while the other side of tape 202 can hold extension lashes 200.

Figure 3:
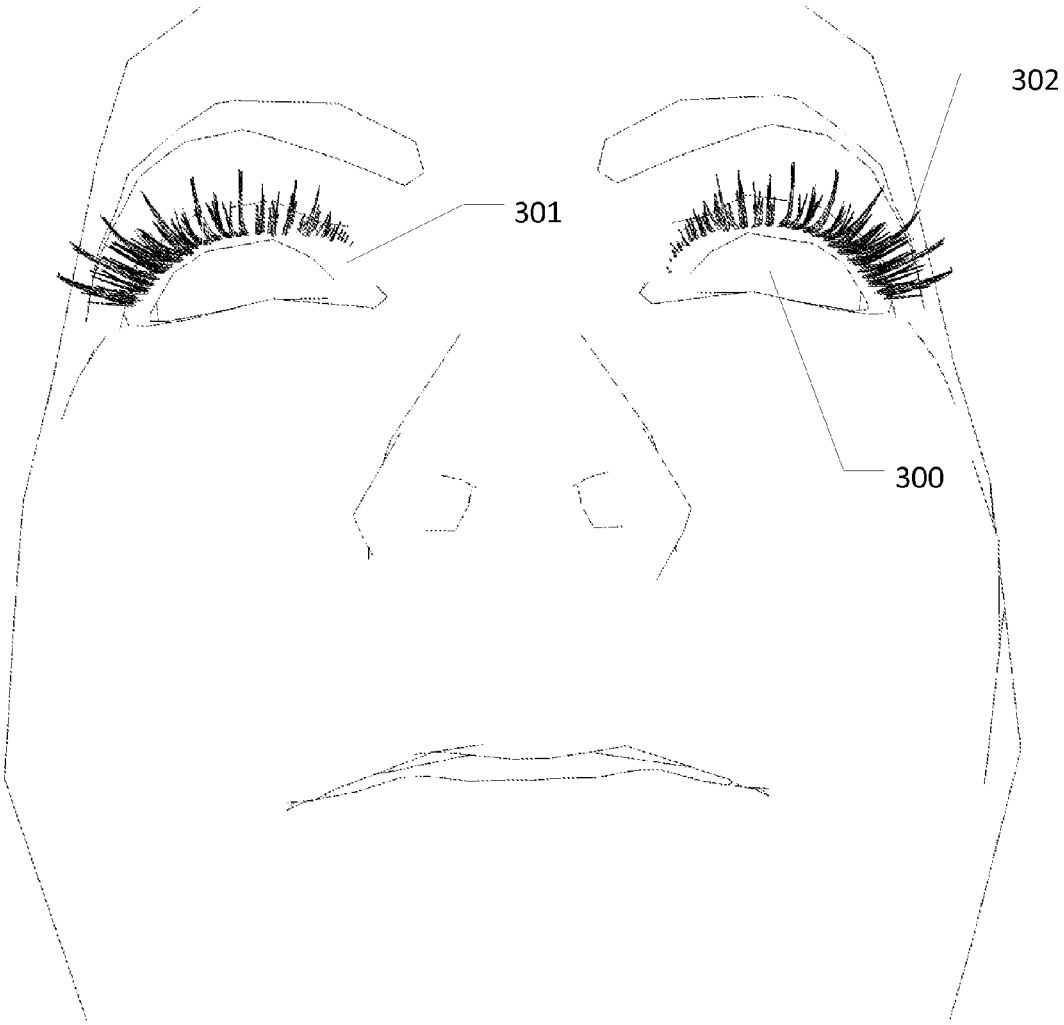
FIG. 3 illustrates a plurality of eyelashes on a face.

FIG. 3 illustrates a human face comprising eyes 300. Eyes 300 can comprise eyelids 301, and a plurality of eyelashes 302. Eyes 300 can have different types, as eyes 300 vary in shapes and sizes such as, but not limited to, almond-shaped, oval-shaped, round-shaped, small and/or big eyes. Eyelids 301 can be divided into zones, in which extension lashes 200 can be attached in order to create different looks.

Figure 4A:
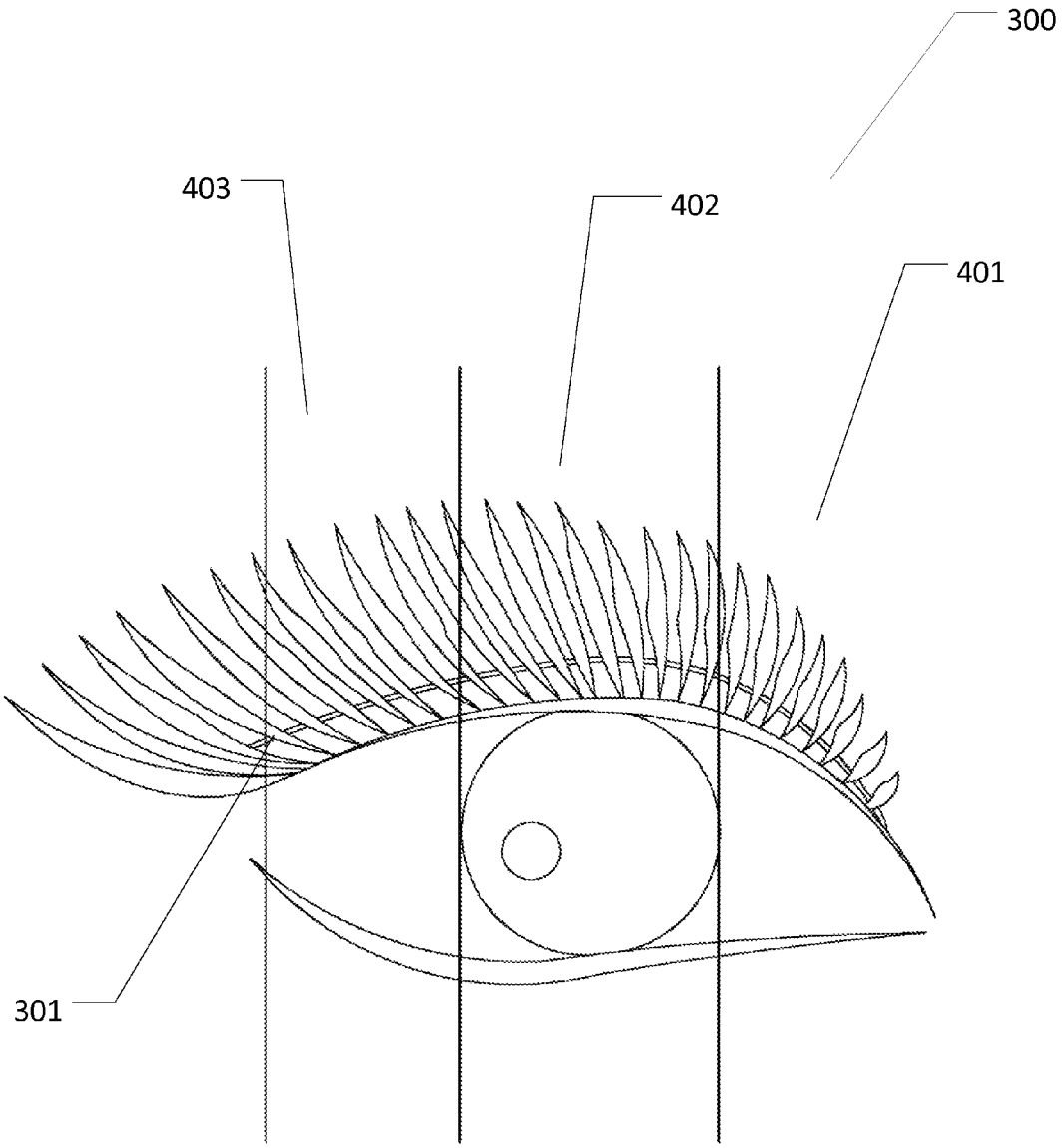
FIG. 4A illustrates how an eyelid can be divided into three zones.

FIG. 4A illustrates how eyelids 301 can be divided into three zones. In such embodiment, eyelids 301 can comprise an inner zone 401, middle zone 402, and outer zone 403. Inner zone 401 can be an area of eyelid 301 that can be near the tear ducts of eye 300. Middle zone 402 can be the center portion of eyelid 301 located just above the pupil. Outer zone 403 can be the portion of eyelid 301 farther from the tear ducts.

Figure 4B:
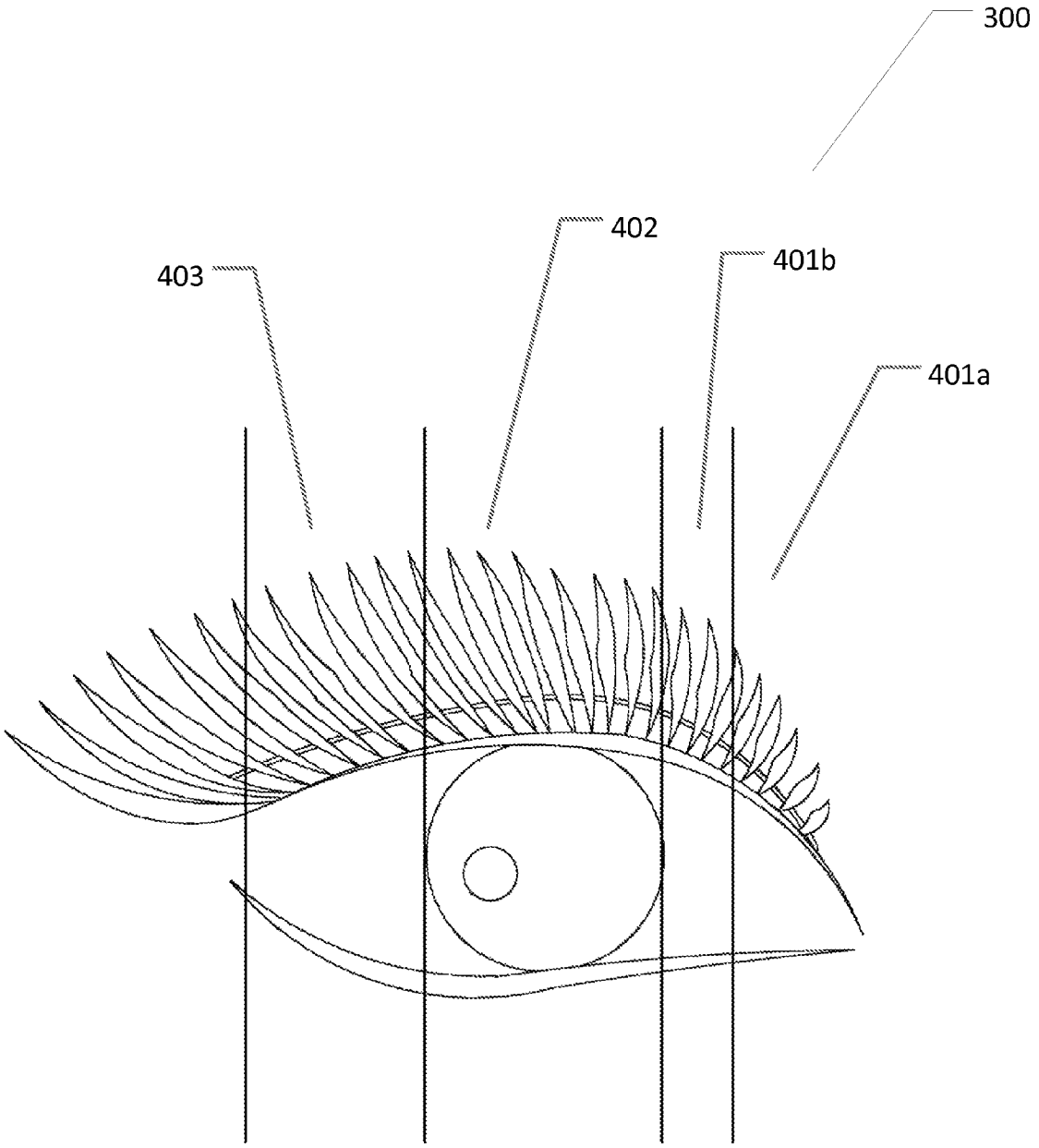
FIG. 4B illustrates how an eyelid can be divided into four zones.

FIG. 4B illustrates how eyelids 301 can be divided into four zones. In such embodiment, inner zone 401 can be divided into two sections. As such, inner zone 401 can comprise first inner zone 401*a*, and a second inner zone 401*b*. First inner zone 401*a* can be a portion closest to the tear ducts. Second inner zone 401*b* can be the portion connecting first inner zone 401*a* and mid-zone 402.

Figure 5A:
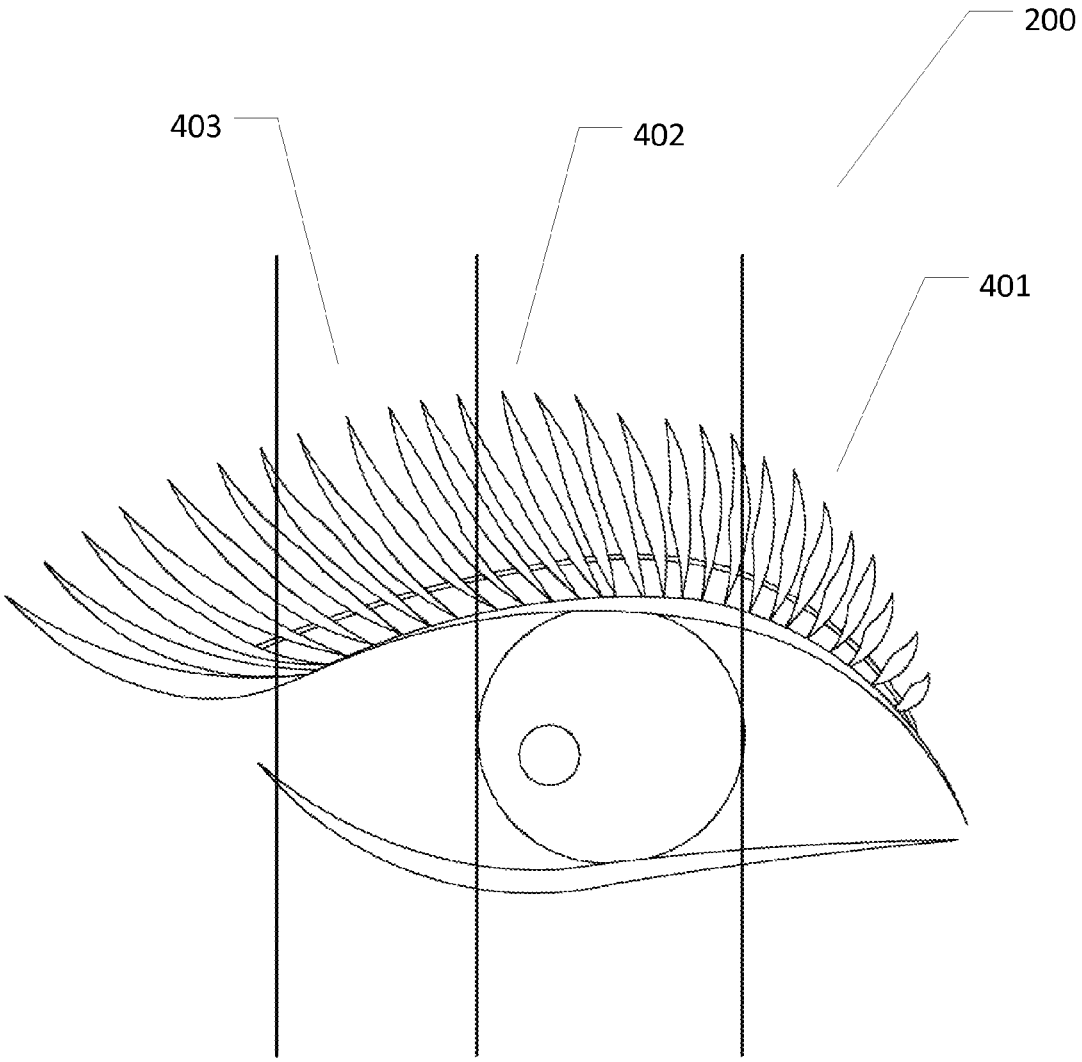
FIG. 5A illustrates how to make an extension lashes appear natural when applied unto eyelashes.

FIG. 5A illustrates how to make extension lashes 200 appear natural when applied onto eyelashes 302. In such embodiment, extension lashes 200 can be attached on inner zone 401. Length extension lashes 200 with a length one-millimeter longer than the inner zone lashes can be applied to middle zone 402. Extension lashes 200 on outer zone 403 can be one-millimeter longer than middle zone 402. In one embodiment, inner zone 401 can comprise eight-millimeter extension lashes 200, middle zone 402 can have nine-millimeter extension lashes 200, and outer zone 403 can comprise ten-millimeter extension lashes.

Figure 5B:
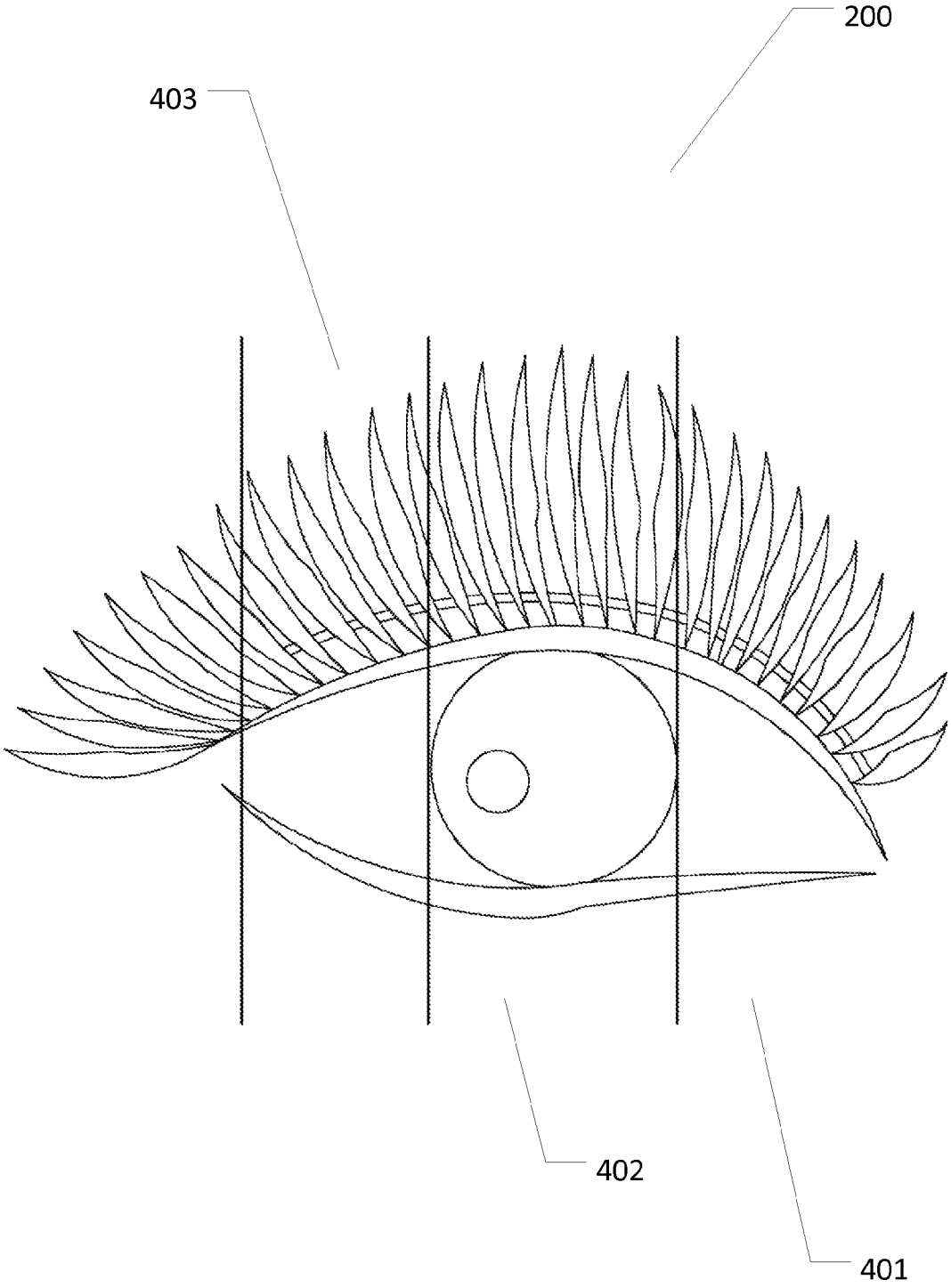
FIG. 5B illustrates application of an extension lashes unto eyelashes to achieve a cute or doll-eyed look.

FIG. 5B illustrates application of extension lashes 200 onto eyelashes 302 to achieve a cute or doll-eyed look. In such embodiment, extension lashes 200 can be attached on inner zone 401. Length extension lashes 200, having a length that is two-millimeters longer than the inner zone lashes, can be applied to middle zone 402. Extension lashes 200 on outer zone 403 can be one millimeter shorter than the middle zone 402. As a non-limiting example, inner zone 401 can comprise eight-millimeter extension lashes 200, middle zone 402 can have ten-millimeter extension lashes 200, and outer zone 403 can comprise nine-millimeter extension lashes.

Figure 5C:
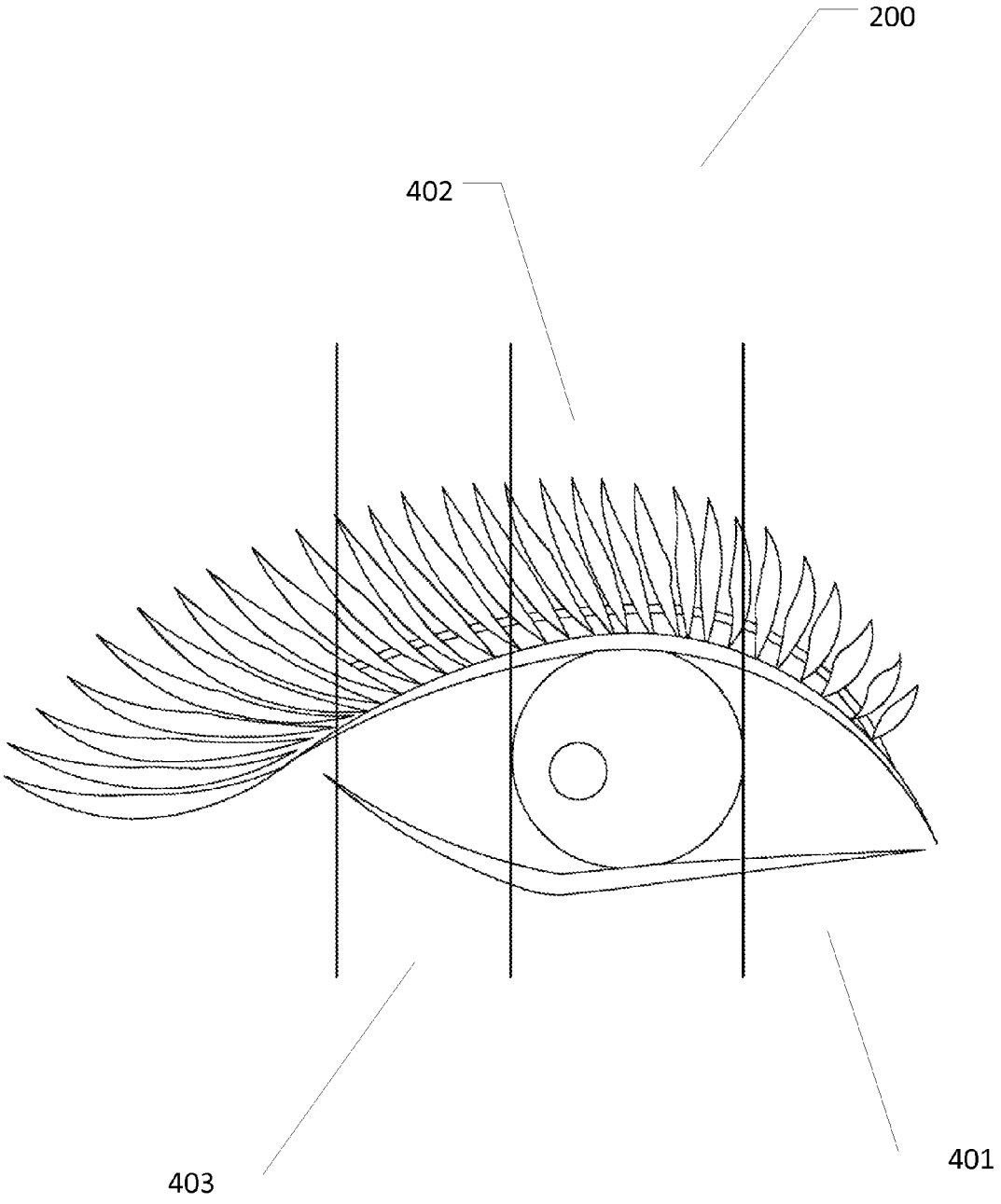
FIG. 5C illustrates application of an extension lashes unto eyelashes to achieve a sexy look.

FIG. 5C illustrates application of extension lashes 200 on to eyelashes 302 to achieve sexy look. In such embodiment, extension lashes 200 can be attached on inner zone 401. Length extension lashes 200 having a length two-millimeter longer than the inner zone lashes can be applied to middle zone 402. Outer zone 403 extension lashes 200 can be two or three-millimeters longer than middle zone 402. As a non-limiting example, inner zone 401 can comprise eight-millimeter extension lashes 200, middle zone 402 can have ten-millimeter extension lashes 200, and outer zone 403 can comprise twelve or thirteen-millimeter extension lashes. Such applications of extension lashes 200 on eyes 300 can create a seductive look and make eyes 300 appear almond in shape.

Figure 5D:
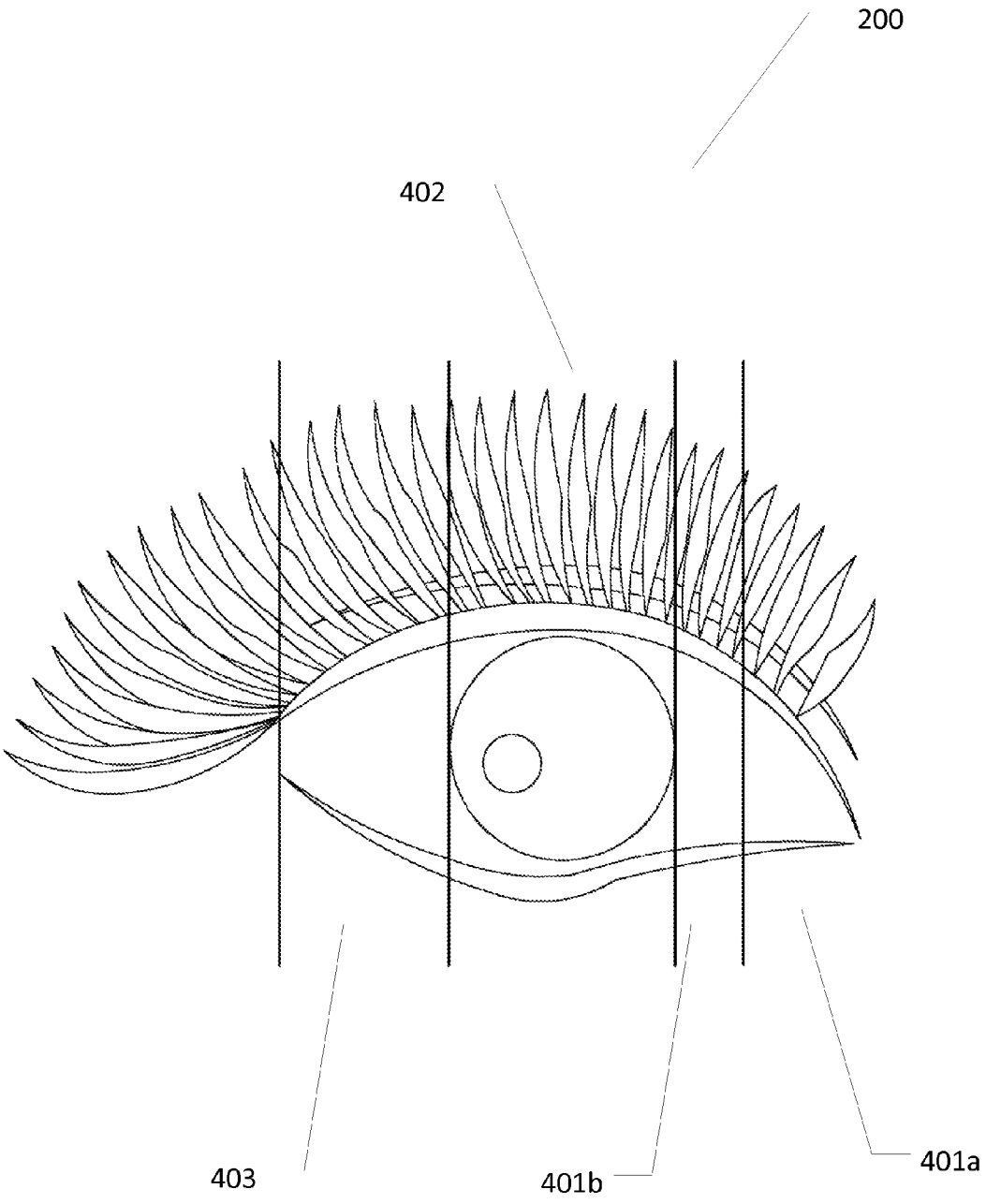
FIG. 5D illustrates application of an extension lashes unto eyelashes to achieve a gorgeous look.

FIG. 5D illustrates application of extension lashes 200 onto eyelashes 302 to achieve a gorgeous look. In such embodiment, extension lashes 200 can be attached on first inner zone 401*a*. Length extension lashes 200 having a length one-millimeter longer than first inner zone lashes can be applied to second inner zone 401*b*. Length extension lashes 200 having a length one-millimeter longer than first inner zone lashes can be applied to second inner zone 401*b*. Length extension lashes 200 having a length one-millimeter longer than second inner zone lashes can be applied to middle zone 402. Outer zone 403 extension lashes 200 can be the same length as lashes of the middle zone 402. As a non-limiting example, first inner zone 401*a* can comprise eight-millimeter extension lashes 200, second inner zone 401*b* can comprise nine-millimeter lashes, middle zone 402 can have ten-millimeter extension lashes 200, and outer zone 403 can comprise ten-millimeter extension lashes. In such embodiment, eyes 300 can look more dramatic, attractive, and fuller.

For purposes of this disclosure, different thickness and curls of extension lashes 200 can be applied in different zones to achieve various looks for the user. To make eyes 300 appear larger and wider, thin and/or thick extension lashes 200 can be applied onto eyelashes 302. Additionally, extension lashes 200 can vary from curled to extra-curled to open up eyes 300 and make them appear larger. To make eyes 300 appear smaller, a thicker and/or extra-thick extension lashes 200 can be applied onto eyelashes 302. Selecting and applying more extension lashes 200 can make eyes 300 appear smaller and full.

Figure 6:
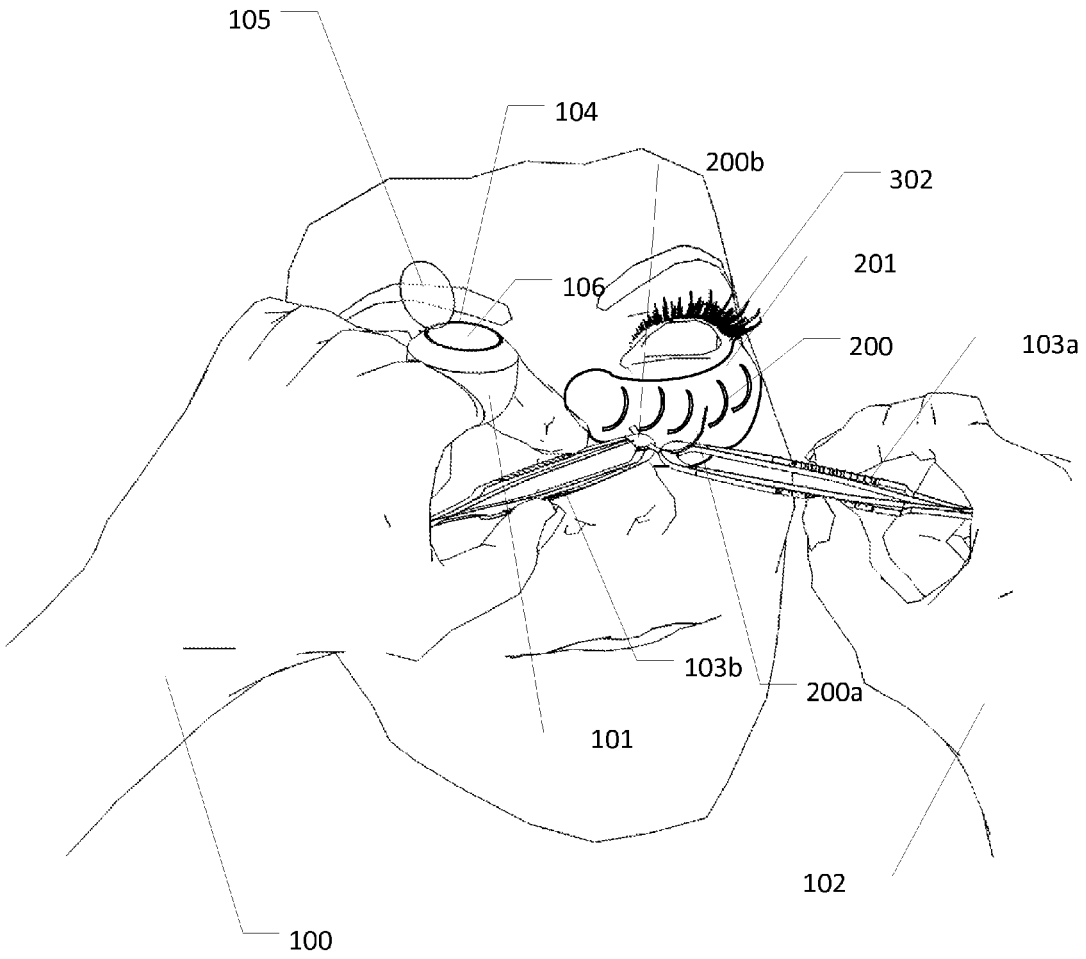
FIG. 6 illustrates how an extension lashes can be applied to a plurality of natural eyelashes.

FIG. 6 illustrates how extension lashes 200 can be applied onto eyelash 302. Eye patch 201 can be placed on a portion of human face or at the back of first hand 100. Second hand

102 holding forceps 103 can be used to pick extension lashes 200 from eye patch 201, or from tape 202 in an embodiment where tape 202 holds extension lashes 200. Extension lashes 200 can be picked using forceps 103 near the base 200*b*. As such, extension lashes 200 can be easily grasped, and directed into a desired area. Concurrently, first hand 100 wearing ring 101 can be moved towards second hand 102 in order to dip base 200*a* into container 104. As such, base 200*a* can be coated with glue 106. Further, base 200*a* can be attached near the bottom of single natural eyelash 302. Extension lashes 200 can be attached one at a time and/or per row on every individual natural eyelash 302.

In one embodiment, first hand 100 can hold forceps 103*b* and second hand 102 can hold first forceps 103*a*. First hand 100 can separate lashes on eye by using first forceps 103. As first hand 100 adjusts space between lashes accordingly to clear space, second hand 102 can manipulate lash extension. Second hand 102 can use second forceps 600 to pick up lash off from strip, dip lash in adhesive/glue and apply lash to space created between lashes from first hand 100 using first forceps 103. In one embodiment, strip can be on the first hand 100 with ring 101. Eye patch 201 can be placed on a portion of user's face (such as on under-eye covering) or at the back of first hand 100. Second hand 102, using forceps 103*a* can pick an extension lash 200 from eye patch 201 or from tape 202. Concurrently, first hand 100 wearing ring 101 can be moved towards second hand 102 in order to dip base 200*a* into container 104, coating base 200*a* with glue 106. Base 200*a* can then be attached near to natural eyelash 302.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A method of extending eyelashes comprising wearing a ring on a first hand said ring comprising a bowl, said bowl comprising eyelash adhesive; and attaching a first side of an eye patch to a surface, wherein said surface is one of a back of the first hand or a portion under an eye of said user's face;

attaching tape on a second side of said eye patch;

supporting a plurality of loose extension lashes on said tape;

removing one of said extension lashes from said tape with forceps, said forceps in a second hand;

dipping a portion of said extension lash into said eyelash adhesive within said ring; and attaching said eyelash extension to a natural lash on a user.

2. The method of claim 1, wherein said surface is the back of said first hand.

3. The method of claim 1, wherein said surface is a portion under the eye of said user's face.

4. The method of claim 1 further comprising the step of repeatedly removing a next extension lash from said tape with said forceps, dipping said next extension lash in eyelash adhesive within said ring, and attaching said next extension lash to a next natural lash on said user, until said user comprises a complete set of said extension lashes.

5. The method of claim 1 wherein said tape comprises a tape adhesive on a first tape side.

6. The method of claim 5 wherein said tape comprises said tape adhesive on said second side.

7. The method of claim 5 wherein said tape adhesive attaches said tape to said eyepatch.

8. The method of claim 7 wherein said tape adhesive connects said lash extensions to said tape.

9. The method of claim 1 further comprising the step of manipulating said natural lashes with a second forceps in said first hand.

* * * * *